US005454678A

United States Patent [19]

Hefty

[11] Patent Number: 5,454,678

[45] **Date of Patent: * Oct. 3, 1995**

[54] METHOD OF MAKING PERSONALIZED CHILDREN'S STORYBOOK UTILIZING STICKERS

[76] Inventor: John B. Hefty, 976 Grand Canal St., Gulf Breeze, Fla. 32561

[ * ] Notice: The portion of the term of this patent subsequent to Mar. 2, 2010 has been disclaimed.

[21] Appl. No.: 151,893

[22] Filed: Nov. 15, 1993

[51] Int. Cl.[6] ..... B42C 19/00; B42D 1/00

[52] U.S. Cl. ..... 412/1; 281/15.1; 283/63.1; 283/81; 283/67

[58] Field of Search ..... 281/15.1; 283/81, 283/63.1, 67, 117; 412/1

[56] References Cited

U.S. PATENT DOCUMENTS

| | | | |
|---|---|---|---|
| 3,982,744 | 9/1976 | Kraynak et al. | 270/12 |
| 4,143,889 | 3/1979 | Scharlin | 281/15.1 |
| 4,493,650 | 1/1985 | Kaufmann et al. | 434/178 |
| 4,714,275 | 12/1987 | Engel et al. | 281/15.1 |
| 5,031,935 | 7/1991 | D'Andrea | 281/15.1 |
| 5,114,291 | 5/1992 | Hefty | 283/67 X |
| 5,190,316 | 3/1993 | Hefty | 281/15.1 |
| 5,213,461 | 5/1993 | Kalosher | 281/15.1 |
| 5,238,345 | 8/1993 | D'Andrea | 283/67 X |

FOREIGN PATENT DOCUMENTS

| | | |
|---|---|---|
| 8101384 | 10/1981 | Netherlands . |
| 2207090 | 1/1989 | United Kingdom . |

*Primary Examiner*—S. Thomas Hughes
*Attorney, Agent, or Firm*—George A. Bode

[57] ABSTRACT

A method of making a personalized children's storybook using preprinted books and inserting stickers containing personalized data to create a personalized book.

3 Claims, 2 Drawing Sheets

METHOD OF MAKING PERSONALIZED CHILDREN'S STORYBOOK UTILIZING STICKERS

BACKGROUND AND INTRODUCTION

The invention pertains to a method of making a book and the book itself. More particularly, the invention pertains to a method of making a personalized children's storybook using preprinted books and inserting stickers containing personalized data to create a personalized book.

The present invention is an advance over the prior art because until now personalized books could not be sold off the shelf because they were still in pieces until the personalized data was added (see U.S. Pat. No. 3,982,744) . Personalized books could only be sold through mall order and received after several weeks of waiting by the customer, or sold on site and manufactured for the customer while the customer waited while the personalized book was being printed and assembled. The present invention allows preprinted personalized books to be merchandized throughout the country on bookshelves. In one embodiment of the present invention, the customer can give a telephone operator the personalized data and receive by mail a sheet of stickers containing the personalized data to be placed in the preprinted book.

SUMMARY OF THE INVENTION

In one aspect, the present invention provides a method of making a personalized book wherein a specially preprinted book is prepared and adapted to have personalized stickers inserted at specific locations in the preprinted book so as to match up with sections requiring the personalized data on the personalized stickers. The preprinted book can be produced by conventional methods and contains non-variable text and also usually contains illustrated matter. The non-variable text comprises general information which does not change or vary from book to book of the same title. The personalized stickers comprises specific information which changes or varies for each book depending on the recipient of the book. These personalized stickers are determined by the identity of the intended recipient of the book. When the purchaser of the book specifies the individual for whom the book is to be personalized, the printer conveys the information to an appropriate source for printing of the personalized stickers.

BRIEF DESCRIPTION OF THE DRAWINGS

The present invention will be further understood from the accompanying drawings, wherein.

DETAILED DESCRIPTION OF THE INVENTION

Figure 1:
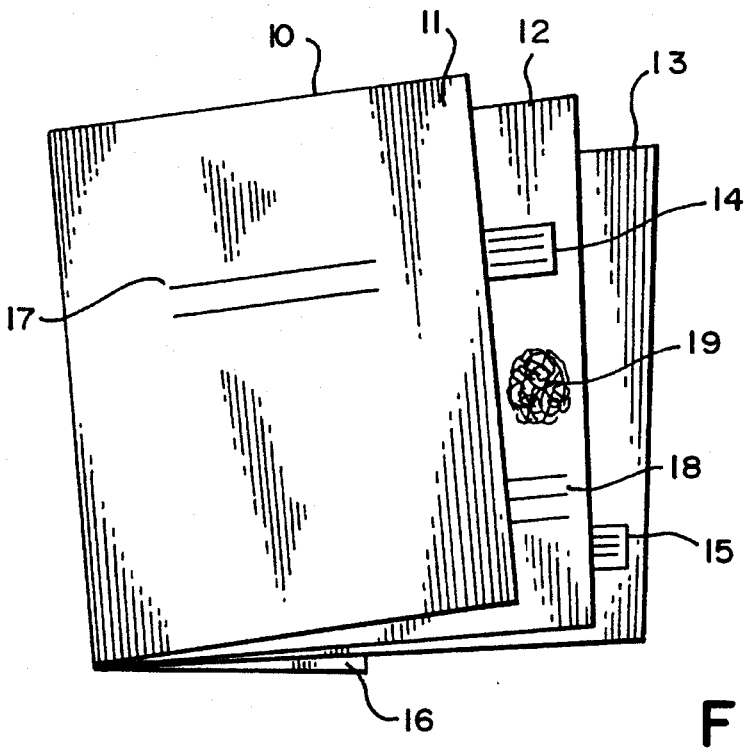
FIG. 1 is a perspective view of a children's storybook made in accordance with the present invention.

In further detail and with reference to the drawings, FIG. 1 shows a preprinted book 10 containing a plurality of pages 12, 13, etc. and a front cover 11 and a back cover 16. The book is made and bound using conventional methods known in the art. The book can be mass produced and purchased by a Buyer from a Seller. The non-variable text 18 (optionally including the title 17) includes general information that is common to every book of the same title. Typically, the non-variable text 18 includes a children's story having a theme to which most children can generally relate. For example, the children's story can concern a story about a child. Various sections of the preprinted book are to be replaced with personalized stickers 14, 15 containing personalized information, i.e., child's name, time and place where child was born, height and weight of child, etc., based on the intended recipient of the book. The book can optionally contain illustrations 19.

Figure 2:
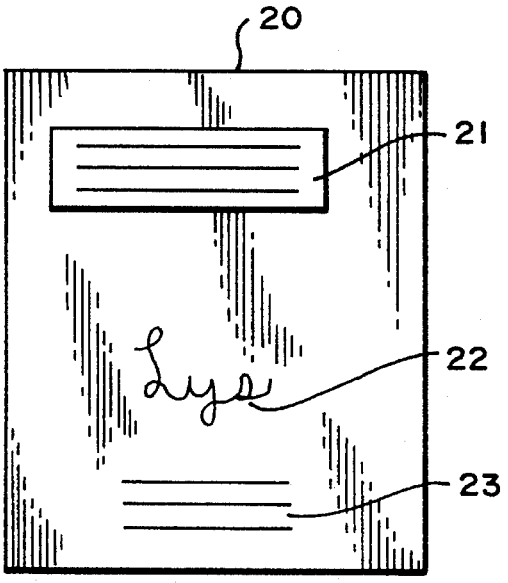
FIG. 2 is a plan view of a page from the book showing the stickers according to the invention.

FIG. 2 is a representation of a single page 20 from the storybook of the invention showing the preprinted illustration 22, preprinted non-variable text 23, and the personalized sticker 21 which has replaced a section of the preprinted book intended to be replaced with a personalized sticker.

Figure 3:
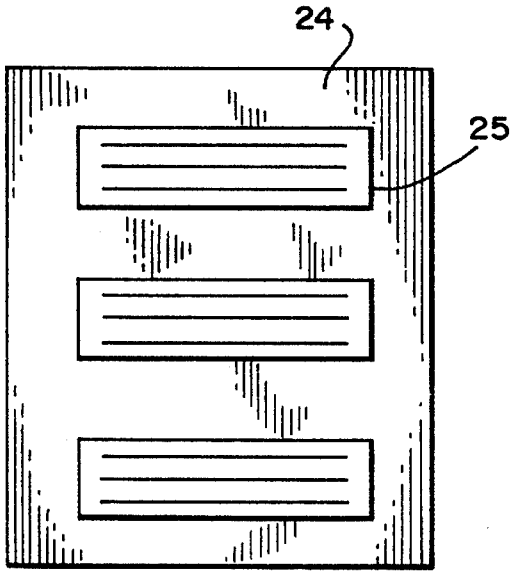
FIG. 3 is a plan view of a page of stickers in accordance with the invention.

Personalized data are printed on adhesive stickers by the Printer. The Buyer will give the Printer of the stickers the personalized data at the time the preprinted book is purchased or at a later date. The stickers are then made. FIG. 3 shows a page 24 of the book containing a plurality of personalized stickers 25. The variable text includes specific, personal information about a child who is the recipient the book. Typically, the variable text includes the name, address, and age of the child, names of friends and/or relatives of the child, as well as other information of a personal nature about the child. The stickers are printed using conventional methods, for example a laser printer. The adhesive stickers can be self-adhesive "peel off" type or may require the addition of an adhesive. The adhesive sticker containing the new personalized data is pressed against the appropriate area of the book (i.e., the section to be replaced) to thereby form a personalized book. The sticker containing the personalized data will thus replace the section of the preprinted book which was to be replaced with the personalized sticker. The Buyer will know which of the personalized stickers goes on which page because of the personalized data contained on the sticker; for example, if the section of the preprinted book calls for "place where baby was born" then the personalized sticker containing that information will replace that section. Alternatively, the stickers will replace numbered blank sections in the storybook; the stickers can be numbered so that the Buyer will know which sticker will replace which numbered blank section.

Figure 4:
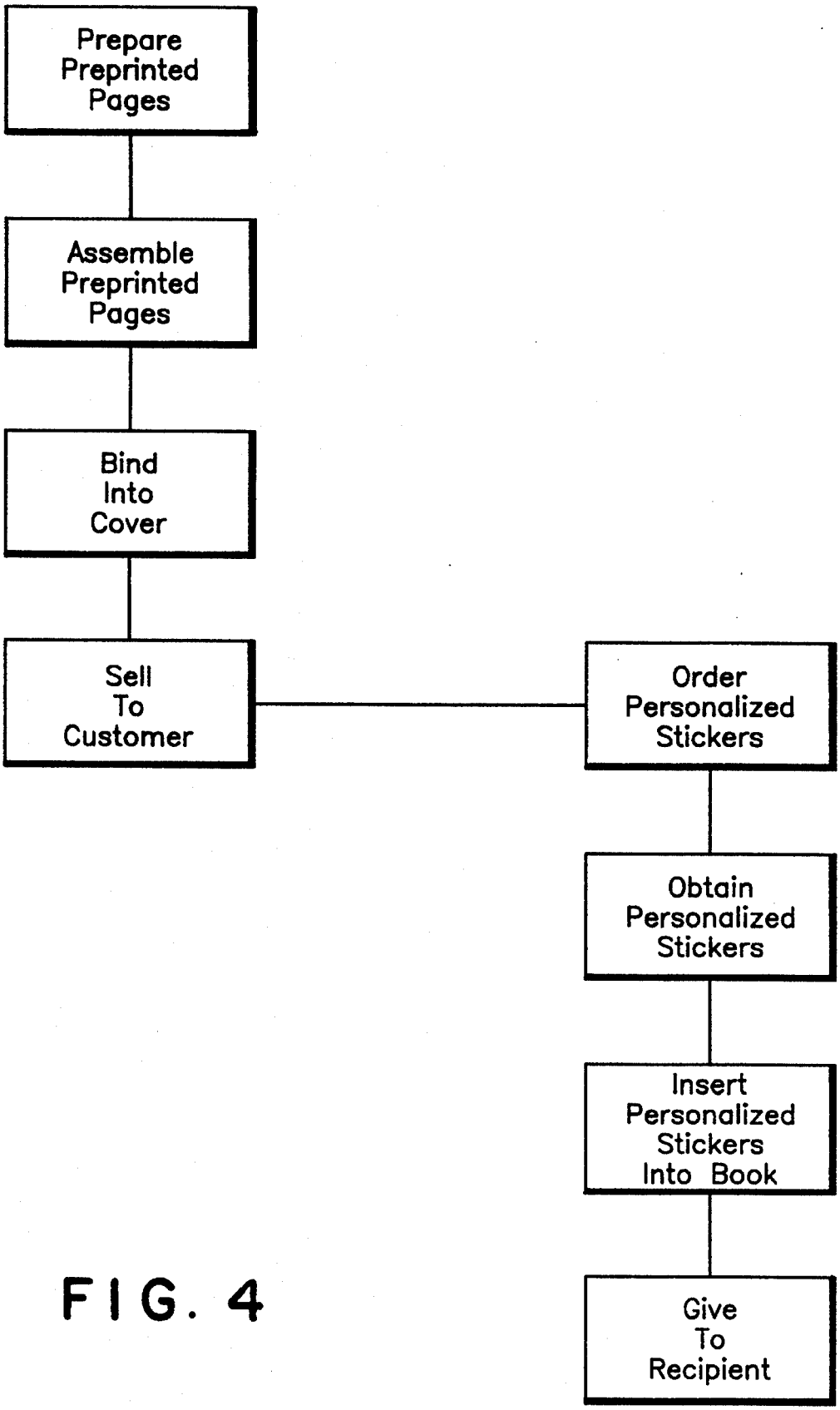
FIG. 4 is a typical flow chart showing how the present invention is carried out.

FIG. 4 is a schematic flow diagram illustrating the overall process.

The stickers being utilized can be blended into the background of the preprinted book. The way to "hide" the sticker containing the new text may include coloring the sticker in the same pattern as the area on which it is to be placed. The sticker can be a copy of a part of a particular page in the preprinted book and would replace the corresponding part of the preprinted book. The sticker would blend in with the background of the page but have the appearance of being printed directly on the page. In addition, the stickers can contain drawings (e.g., the sun, the stars, a mailbox with the recipient's name). The stickers can also be made of a special material which will become hardly visible when affixed to the appropriate place on the preprinted page.

Although the invention has been described with reference to preferred embodiments, numerous modifications and rearrangements can be made with the result still coming within the scope of the invention.

U.S. Pat. No. 5,190,316 which is relied on and incorporated herein by reference in its entirety.

What is claimed is:

1. A method of making a to-be-completed personalized children's storybook containing a children's story and optionally illustrations, said method comprising the steps of:

(a) preprinting a storybook containing a story set forth in non-variable text and optionally illustrations, and providing a plurality of sections at selected locations in said storybook to be replaced with personalized stickers;

(b) obtaining personal data about an intended recipient of said storybook to replace said plurality of sections at selected locations in said storybook;

(c) providing an adhesive sticker for each of said selected locations, with said stickers being adapted to replace said sections;

(d) printing said personal data on said adhesive stickers in such a manner that the thus imprinted stickers can replace said sections thereby enabling one to read said personalized storybook from start to finish, wherein said adhesive stickers are adapted to change said storybook to a storybook concerning said intended recipient, wherein said adhesive stickers are adapted to replace sections of said storybook which sections call for personalized data contained on said adhesive stickers, wherein each of said stickers is adapted to blend in with the specific background of the specific location in said storybook to which they are to be applied so as to have the appearance of being printed directly on the page of said storybook to which they are intended to be applied, and wherein said stickers, after said printing, contain personal data called for in the sections said stickers are intended to replace, whereby the thus imprinted stickers can be applied onto the storybook to complete the personalized storybook.

2. The method according to claim 1, further comprising providing said stickers to customers of said book to enable said customer to complete said personalized storybook.

3. A method of making a to-be-completed personalized children's storybook containing a children's story and optionally illustrations, said method comprising the steps of:

(a) preprinting a storybook containing a story set forth in non-variable text and optionally illustrations, and providing a plurality of sections at selected locations in said storybook to be replaced with personalized stickers;

(b) obtaining personal data about an intended recipient of said storybook to replace said plurality of sections at selected locations in said storybook;

(c) providing an adhesive sticker for each of said selected locations, with said stickers being adapted to replace said sections;

(d) printing said personal data on said adhesive stickers in such a manner that the thus imprinted stickers can replace said sections thereby enabling one to read said personalized storybook from start to finish, wherein said adhesive stickers are adapted to change said storybook to a storybook concerning said intended recipient, wherein said adhesive stickers are adapted to replace sections of said storybook which sections call for personalized data contained on said adhesive stickers, wherein each of said stickers is adapted to blend in with the specific background of the specific location in said storybook to which they are to be applied so as to have the appearance of being printed directly on the page of said storybook to which they are intended to be applied, and wherein said stickers, after said printing, contain personal data called for in the sections said stickers are intended to replace; and (e) applying the thus imprinted stickers onto said storybook to replace said sections.

* * * * *